US005330232A

United States Patent [19]

Smith

[11] Patent Number: 5,330,232

[45] Date of Patent: Jul. 19, 1994

[54] CLEAR WINDOW LABEL

[75] Inventor: Douglas M. Smith, Buffalo, N.Y.

[73] Assignee: Moore Business Forms, Inc., Grand Island, N.Y.

[21] Appl. No.: 957,813

[22] Filed: Oct. 8, 1992

[51] Int. Cl.[5] ..... B42D 15/00

[52] U.S. Cl. ..... 283/81; 428/352

[58] Field of Search ..... 283/81; 428/202, 352; 156/71, 277, 289; 101/188

[56] References Cited

U.S. PATENT DOCUMENTS

| | | | |
|---|---|---|---|
| 4,421,816 | 12/1983 | Arnold | 428/202 |
| 4,568,403 | 2/1986 | Egan | 156/289 |
| 4,661,189 | 4/1987 | Voy et al. | 156/248 |
| 4,960,482 | 10/1990 | Crane et al. | 156/277 |
| 4,999,076 | 3/1991 | Incremona et al. | 156/241 |
| 5,096,767 | 3/1992 | Harada et al. | 428/204 |
| 5,104,719 | 4/1992 | Kamen et al. | 428/195 |

*Primary Examiner*—Mark Rosenbaum
*Assistant Examiner*—Kenneth J. Hansen
*Attorney, Agent, or Firm*—Nixon & Vanderhye

[57] ABSTRACT

A removable label is readily attached to a transparent surface, such as a glass window, and has both variable and non-variable printing. A removable adhesive is applied to the front face of a clear plastic film, and a release liner is applied on the adhesive, and reverse non-variable printing is provided on the back face of the film. Variable printing is provided either by putting a toner receptive coating on the back of the film and reverse printing the variable indicia on the toner receptive coating, or by printing onto bond paper with variable indicia, providing a permanent adhesive coat to the back face of the film, and pressing the bond paper into contact with the permanent adhesive so that the variable indicia is visible and readable through the transparent surface.

11 Claims, 3 Drawing Sheets

FIG. 1
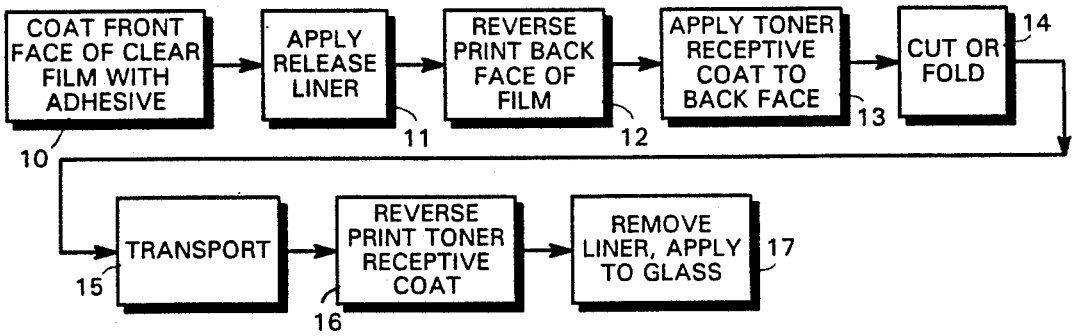
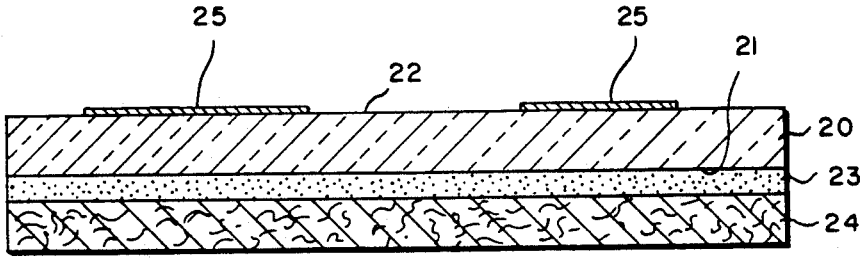
FIG. 2
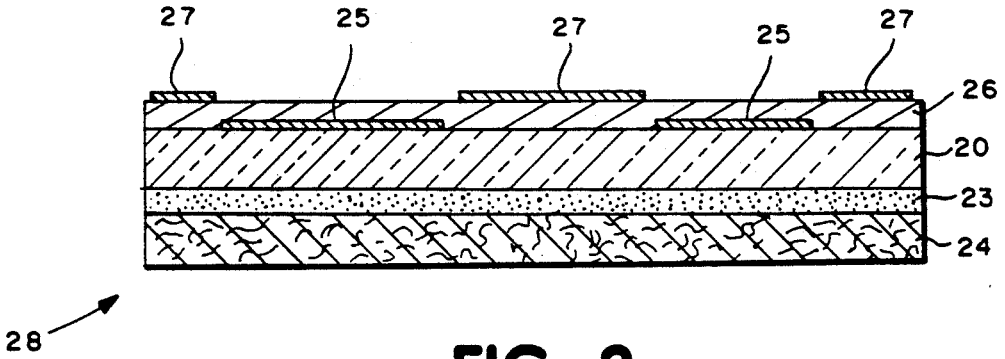
FIG. 3

CLEAR WINDOW LABEL

BACKGROUND OF THE INVENTION

There are many environments in which it is desirable to put a label on a transparent surface, such as a glass window (like a store window, windshield of a vehicle, etc. ) so that indicia on the label is visible through the glass. It is also often desirable for the label to have both variable information and non-variable information.

According to the present invention, a method is provided for the production of labels, typically removable labels, for use with transparent surfaces, which readily may be provided with non-variable indicia, and then may be sent to a customer or ultimate user site for the printing of variable indicia. The invention also relates to a particular label produced according to the invention. Despite the great utility and versatility of labels produced according to the invention, they are produced in a very simple and straightforward manner with no wasted effort or components.

There are two embodiments of label according to the present invention. In the first embodiment of the label, an adhesive coat is provided on the front face of a clear film (such as polyester, polyethylene, polystyrene, or polypropylene). The adhesive coat is preferably a removable adhesive, such as Franklin Covinax 210-00, or the like. To protect the adhesive coat it preferably is covered with a suitable silicone release liner. On the back face of the film non-variable indicia is reverse printed (that is, printed in mirror image so that the alphanumeric characters thereof are readable through the transparent surface to which the label is to be applied, and through the plastic film). Also on the back face of the film is a toner receptive coating (e.g., such as Water Ink Technology WVL001680 or the like), over the printing on the film. Variable indicia is :reverse printed on the toner receptive coating, so that both the non-variable and variable indicia are readable through the transparent surface, plastic film, and—in the case of the variable indicia—the toner receptive coating. To use the label one merely removes the release liner and presses the removable adhesive into contact with the transparent surface.

In a second embodiment, the basic components are the same, only instead of a toner receptive coating a second adhesive coating (such as a permanent adhesive) is applied to the back face of the film, and a second release liner is placed over the permanent adhesive coat. At the customer or user site, the second release liner is removed and variable indicia is printed on a paper sheet, and the paper sheet is pressed into engagement with the permanent adhesive. When the first release liner is removed and the label is pressed into contact with the transparent surface, both the variable and non-variable alphanumeric characters are readable through the transparent surface, and film, and in the case of the variable data, the permanent adhesive.

According to another aspect of the present invention a method of making a label having variable and non-variable indicia from a plastic film having front and back faces, is provided. The method comprises the following steps: (a) Applying an adhesive to the front face of the transparent film. (b) Printing non-variable indicia on the back face of the film. (c) Applying a coating over the non-variable indicia printed on the back face of the film. And, (d) providing printed variable indicia so that it is in operative contact with the coating on the back face of the film.

Step (b) may be practiced by reverse printing non-variable indicia, and step (d) is practiced so that the variable indicia is visible through the film. There is also typically the further step (e) of applying the adhesive on the front face of the film to a transparent surface so that both the variable and non-variable indicia are visible and readable through the transparent surface and transparent film.

Step (c) may be practiced by applying a toner receptive coating to the back face of the film in which case step (d) is practiced by reverse printing directly on the toner receptive coating. Alternatively, step (c) is practiced by applying an adhesive coat to the back face of the film, in which case step (d) is practiced by printing variable indicia on a bond paper sheet, and applying the sheet to the adhesive coat on the back face of the film.

The invention further comprises a method of creating a label or intermediate, using a web of transparent film having front and back faces, comprising the steps of substantially sequentially: (a) Applying an adhesive coat to the front face of the web of transparent film. (b) Applying a release liner to the adhesive coat on the front face of the film. (c) Reverse printing indicia on the back face of the film. And, (d) cutting the web into sheets or folding it into pads.

The invention also comprises a label of a transparent film having front and back faces, a first adhesive coat (preferably removably adhesive) disposed on the front face, and reverse printed indicia on the back face. When the adhesive is placed in contact with a transparent surface, printed alphanumeric indicia on the back face are readable through the surface, first adhesive coat, and film.

It is a primary object of the present invention to provide a simple functional, and versatile label readable through transparent surfaces, and method of production and utilization thereof. This and other objects of the invention will become clear from an inspection of the detailed description of the invention and from the appended claims.

BRIEF DESCRIPTION OF THE DRAWINGS

FIG. 1 is a schematic showing of a first exemplary method of forming a label for use with a transparent surface, according to the present invention;

FIG. 2 is an enlarged side cross-sectional view illustrating a first label or label intermediate according to the present invention;

FIG. 3 is a view like that of FIG. 2 showing the label intermediate of FIG. 2 after variable indicia has also been provided in association therewith;

DETAILED DESCRIPTION OF THE DRAWINGS

Figure 4:
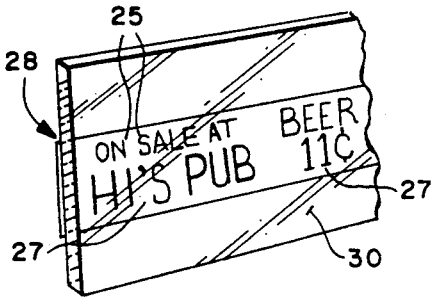
FIG. 4 is a perspective schematic view showing the label of FIG. 3 in operative association with a transparent surface

FIG. 1 schematically illustrates a first embodiment of the method according to the present invention. The method is practiced utilizing a clear film having front and back faces.

As schematically illustrated in FIG. 1, in the first step 10 the front face of a clear film is coated with adhesive, and preferably the operational step 11 of applying a silicone release liner to the adhesive coating is practiced. After step 11 is the step 12 of reverse printing the back face of the film, and then the next step 13 of applying a toner receptive coat to the back face of the film. The steps 10, 11, 12, and 13 are typically practiced at a manufacturing facility, and the reverse printing provided at 13 is non-variable printing. Steps 10 through 13 are typically practiced on a web of film.

After steps 10 through 13, the web is cut into sheets of labels, or folded into pads, at 14, and then is transported as indicated at 15 to a customer or user site. At the customer or user site variable indicia is reverse printed onto the toner receptive coating as indicated at 16. Ultimately, then, the release liner is removed from the adhesive on the front face of the film and is applied to glass, as indicated at 17.

FIG. 2 shows a label or label intermediate produced according to the first steps 10 through 14 of the method of FIG. 1. The transparent film 20 typically is polyester, polyethylene, polystyrene, or polypropylene. It has a front face 21 and a back face 22. Applied to the front face 21 is the first adhesive coat 23, preferably a removable adhesive such as Franklin Covinax 210-00, or the like. A silicone release liner 24 is preferably provided over the adhesive coat 23 to protect it. On the back face 22 reverse printed non-variable indicia 25 is provided, by any suitable printing technique that can apply printing to a plastic film, typically a non-impact printing technique such as laser printing.

Preferably in the same printing operation as the first printed indicia 25 is provided, a thin coating of toner receptive material, such as Water Ink Technology WVL001680, or the like, is provided. The toner receptive coating is shown by reference numeral 26 in FIG. 3. At the user's or customer's site, non-variable alphanumeric indicia is printed onto the toner receptive coating 26, typically by a laser printer or other non-impact printer, in a reverse manner. The reverse printed second (variable) printing is shown by reference numeral 27 in FIG. 3 .

The labels—shown generally by reference numeral 28—of FIG. 3 are utilized in the manner illustrated in FIG. 4 in association with a transparent surface 30, such as a glass window of a building, a vehicle windshield, or the like.

To utilize the label 28 with the transparent surface 30, the release liner 24 is removed and then the adhesive 23 is pressed into contact with the "inside" surface of the window 30. When this is done, both the non-variable alphanumeric printed indicia 25 and the variable alphanumeric printed indicia 27 are visible and readable through the window 30 (and through the adhesive coat 23, film 20 and in the case of the variable printing 27, the toner receptive coating 26).

Figure 5:
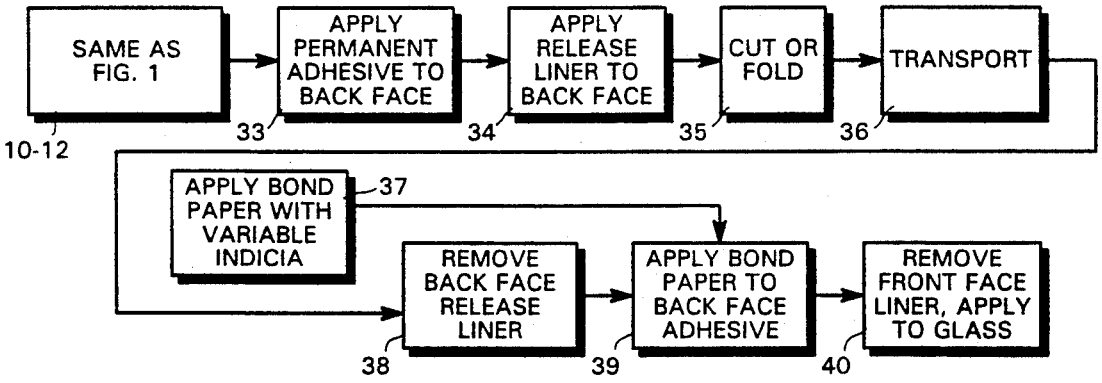
FIG. 5 is a view like that of FIG. 1 for a second embodiment of the method according to the present invention.

FIG. 5 shows a modified method according to a second embodiment of the invention. Steps 10 through 12 are the same as in FIG. 1, but instead of step 13, there is step 33 of applying a permanent adhesive to the back face of the film. After step 33 is step 34 of applying a second release liner to the permanent adhesive on the back face. Then, the web is cut or folded, as indicated at 35, and transported to the customer or user site as indicated at 36. At the customer or user site, bond paper, or like sheet material, has been printed on one face thereof with variable indicia (e.g., by laser printing or the like), as indicated at 37. At the customer or user site, then, the back face release liner is removed as indicated at 38, and the printed face of the bond paper is applied to the back face adhesive as indicated at 39. In the FIG. 5 embodiment, as in the FIG. 1 embodiment, the front face liner may be removed and the label applied to the glass surface as indicated at 40. Alternatively, the front face liner can be removed first and the label applied to the glass, and then the back face release liner removed and the printed bond sheet pressed into contact with the back face adhesive.

The embodiment of FIG. 5 has an advantage compared to the embodiment of FIG. 1 in that the software used to control the customer's non-impact printer, in the variable printing operation (box 37) itself, is simpler because the printing need not be mirror image printing, but normal printing. The method of FIG. 1 is advantageous, however, in that a separate paper sheet may not be utilized, but rather printing may be provided directly on the label.

Figure 6:
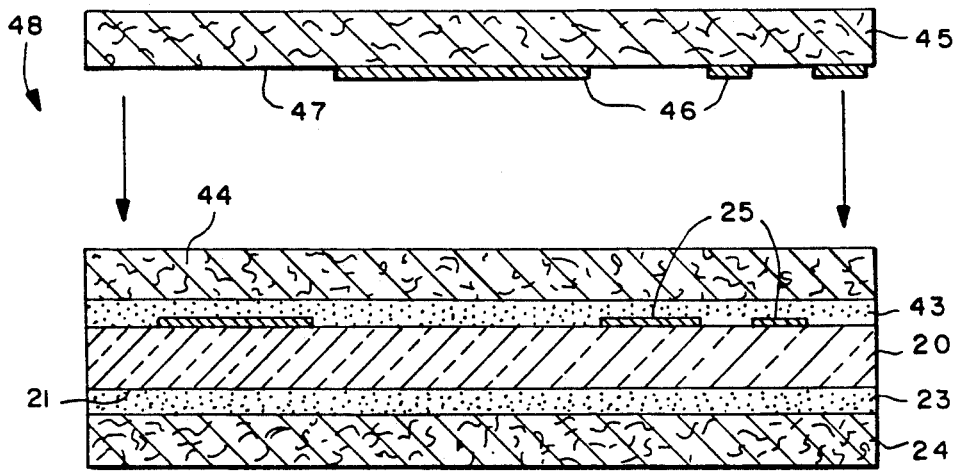
FIG. 6 is a side cross-sectional view of a second label intermediate according to the invention, produced according to the method of FIG. 5.

FIG. 6 illustrates a label and label intermediate produced according to the method of FIG. 5. In this embodiment, components identical to those in the FIGS. 2 through 4 embodiment are shown by the same reference numerals.

In the FIG. 6 embodiment, the coating applied to the back face 22 of the clear film 20 is a permanent adhesive coat 43, which has a second silicone liner 44 applied thereto (at box 34). The bond sheet 45, having variable alphanumeric printed indicia 46 on the front face 47 thereof, is produced at the customer user site, and is moved into contact with the permanent adhesive coating 43 once the second liner 44 is removed.

Figure 7:
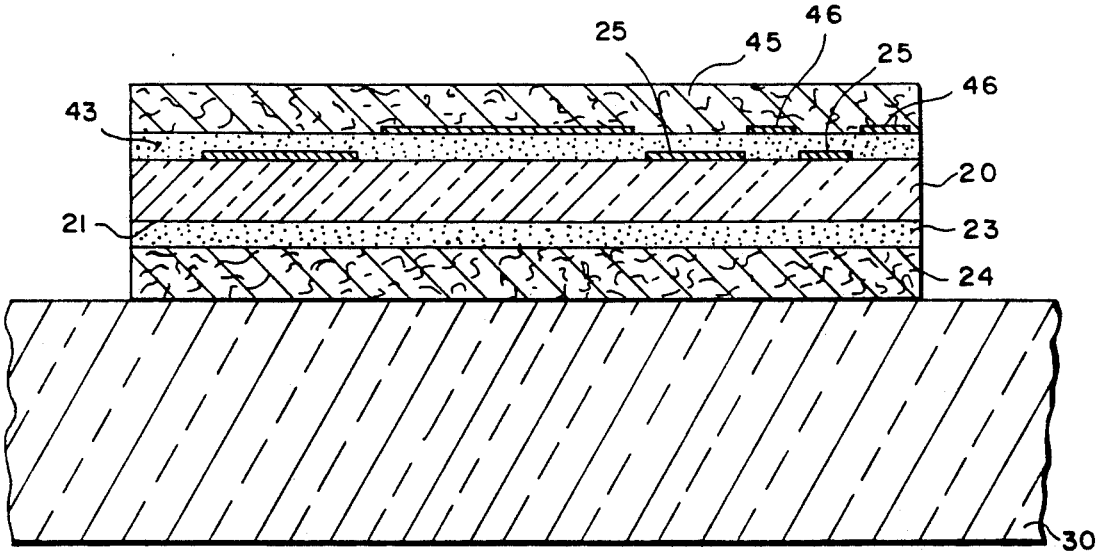
FIG. 7 is a cross-sectional view showing the second embodiment of the label in operative association with a transparent surface.

FIG. 7 shows the label 48 of FIG. 6 in association with a glass window 30, with the removable adhesive 21 in contact with the "inside" face of the glass 30, and with the bond paper sheet 45, and variable printing 46 thereon, pressed into contact with the permanent adhesive coating 43. The non-variable alphanumeric printed indicia 25 and the variable alphanumeric printed indicia 46 are visible through the glass 30, first adhesive 21, and film 20, and the variable indicia 46 is also visible through the permanent adhesive 43.

In both the FIGS. 4 and 7 embodiments, assuming that the first adhesive coat 23 is removable adhesive, the labels 28, 48 can be removed in a manner that is conventional when utilizing removable adhesive like the Franklin Conax 210-00 adhesive. Alternatively, the first adhesive can be re-positional adhesive (such as utilized in the "Note Stix"® products of Moore Business Forms, Inc. of Lake Forest, Ill., or sold by Moore under the "Clean-Tack" trademark), or can also be permanent adhesive if the label is to remain in place indefinitely.

While the invention has been herein shown and described in what is presently conceived to be the most practical preferred embodiment thereof, it will be apparent to those of ordinary ski 11 in the art that many modifications may be made thereof within the scope of the invention, which scope is to be accorded the broadest interpretation of the appended claims so as to encompass all equivalent methods and products.

What is claimed is:

1. A label comprising:

a transparent film having front and back faces;

a first, removable, adhesive coat disposed on said front face;

reverse printed indicia on said back face;

a second adhesive coat disposed on said back face over said reverse printing; and a paper sheet, having printing on a first face thereof; said first face of said paper in contact with said second adhesive coat.

2. A label as recited in claim 1 further comprising a toner receptive coating on said back face, covering said reverse printing on said back face.

3. A label as recited in claim 2 further comprising additional reverse printing provided on said toner receptive coat.

4. A label as recited in claim 1 wherein said transparent film is selected from the group consisting essentially of polyester, polyethylene, polystyrene, and polypropylene.

5. A label in combination with a transparent surface, comprising:

a transparent film having front and back faces;

a first adhesive coat on said film front face and in contact with said transparent surface, holding said film to said surface;

first printed alphanumeric indicia, including alphanumeric characters, on said back face, the alphanumeric characters of said first printed indicia being readable through said surface, first adhesive coat, and film;

a toner receptive coating on said film back face over said first printed indicia; and second printed alphanumeric indicia on said toner receptive coating, the alphanumeric characters of said second printed indicia being readable through said surface, first adhesive coat, film, and toner receptive coating.

6. A label comprising:

a transparent film having front and back faces;

a first removable adhesive coat disposed on said front face;

reverse printed indicia on said back face;

a first release liner disposed on said first adhesive coat;

a toner receptive coating on said back face covering said reverse printing on said back face; and additional reverse printing provided on said toner receptive coat.

7. A label as recited in claim 6 wherein said transparent film is selected from the group consisting essentially of polyester, polyethylene, polystyrene, and polypropylene.

8. A label as recited in claim 6 further comprising a second adhesive coat disposed on said back face over said reverse printing, and a release liner disposed on said second adhesive coat.

9. A label as recited in claim 8 wherein said second adhesive coat comprises permanent adhesive.

10. A label as recited in claim 9 further comprising another release liner, disposed on said first adhesive coat.

11. A label in combination with a transparent surface, comprising:

a transparent film having front and back faces;

a first adhesive coat on said film front face and in contact with said transparent surface, holding said film to said surface;

first printed alphanumeric indicia, including alphanumeric characters, on said back face, the alphanumeric characters of said first printed indicia being readable through said surface, first adhesive coat, and film;

a second adhesive coat on said film back face, covering said first printed indicia;

a sheet of paper having second printed alphanumeric indicia on a first face thereof; and said first face of said paper sheet in contact with said second adhesive coat, so that the alphanumeric characters of said second printed indicia are readable through said surface, first adhesive coat, film, and second adhesive coat.

* * * * *